US011760531B2

(12) United States Patent
Nash et al.

(10) Patent No.: US 11,760,531 B2
(45) Date of Patent: Sep. 19, 2023

(54) DOUBLE-HANDLE BOX

(71) Applicant: Pratt Corrugated Holdings, Inc., Brookhaven, GA (US)

(72) Inventors: Zachery Nash, Decatur, GA (US); Richard Philabaum, Marietta, GA (US)

(73) Assignee: Pratt Corrugated Holdings, Inc, Brookhaven, GA (US)

( * ) Notice: Subject to any disclaimer, the term of this patent is extended or adjusted under 35 U.S.C. 154(b) by 0 days.

(21) Appl. No.: 17/495,531

(22) Filed: Oct. 6, 2021

(65) Prior Publication Data

US 2022/0111996 A1 Apr. 14, 2022

Related U.S. Application Data

(60) Provisional application No. 63/089,824, filed on Oct. 9, 2020.

(51) Int. Cl.

| | |
|---|---|
| ***B65D 5/18*** | (2006.01) |
| ***B65D 71/36*** | (2006.01) |
| ***B65D 5/468*** | (2006.01) |

(52) U.S. Cl.

CPC ..... *B65D 5/4608* (2013.01); *B65D 5/18* (2013.01); *B65D 71/36* (2013.01); *B65D 2571/0045* (2013.01); *B65D 2571/0066* (2013.01)

(58) Field of Classification Search

CPC ..... B65D 5/18; B65D 5/46; B65D 5/4608; B65D 71/36; B65D 2571/0045; B65D 2571/0066

(Continued)

(56) References Cited

U.S. PATENT DOCUMENTS 909,664 A * 1/1909 Porter ..... B65D 5/305 229/117.16
1,962,492 A * 6/1934 Fallert ..... B65D 5/6605 229/120.04

(Continued)

FOREIGN PATENT DOCUMENTS

| | | |
|---|---|---|
| EP | 1876103 | 1/2008 |
| GB | 3005023 | 7/2002 |
| WO | 2010033657 | 3/2010 |

OTHER PUBLICATIONS

Wikipedia; Article entitled: "Corrugated box design", located at <https://en.wikipedia.org/wiki/Corrugated_box_design>, accessed on Jun. 15, 2020, 10 pgs.

(Continued)

*Primary Examiner* — Bryon P Gehman
(74) *Attorney, Agent, or Firm* — Taylor English Duma LLP

(57) ABSTRACT

A blank can include first, second, third, and fourth side panels; the third side panel joining the first side panel and the second side panel and defining a first handle opening; the fourth side panel extending from the second side panel and defining a second handle opening; a plurality of bottom flaps, each of which extends from one of the side panels; and a plurality of top flaps, each of which extends from one of the side panels; the third and fourth top flaps defining third and fourth handle openings, respectively, the third handle opening substantially aligned with the first handle opening and the fourth handle opening substantially aligned with the second handle opening when the third and fourth top flaps, respectively, are in a folded condition; wherein centerlines of the first and second handle openings are respectively aligned with centerlines of the third and fourth handle openings.

21 Claims, 14 Drawing Sheets

(58) Field of Classification Search
USPC ..... 206/427; 229/117.16, 117.17
See application file for complete search history.

(56) References Cited

U.S. PATENT DOCUMENTS

| | | | | |
|---|---|---|---|---|
| 2,004,197 | A * | 6/1935 | Ethridge | B65D 5/448 229/199 |
| 2,718,348 | A | 9/1955 | Montfort | |
| 2,917,220 | A * | 12/1959 | Bostock | B65D 5/448 229/117.17 |
| 2,947,462 | A * | 8/1960 | Bostock | B65D 5/4608 229/199 |
| 3,049,279 | A | 8/1962 | Mairs et al. | |
| 3,583,626 | A | 6/1971 | Overton, III et al. | |
| 4,179,061 | A | 12/1979 | Gilbert | |
| 4,293,091 | A | 10/1981 | Gerard | |
| 4,623,072 | A | 11/1986 | Lorenz | |
| 5,029,710 | A | 7/1991 | Workman et al. | |
| 5,427,306 | A | 6/1995 | Petriekis et al. | |
| 5,494,214 | A | 2/1996 | Fleury et al. | |
| 5,570,834 | A | 11/1996 | Larson et al. | |
| 5,794,780 | A | 8/1998 | Parrella et al. | |
| D437,222 | S | 2/2001 | Goldberg | |
| 6,257,484 | B1 | 7/2001 | Dowd | |
| 6,705,515 | B2 | 3/2004 | Dowd | |
| 7,743,970 | B2 | 6/2010 | Bates et al. | |
| 7,806,313 | B2 | 10/2010 | Philips | |
| 7,832,623 | B1 | 11/2010 | Capogrosso | |
| 7,870,993 | B2 | 1/2011 | Walling | |
| 8,770,468 | B2 * | 7/2014 | Skolik | B65D 5/445 229/199 |
| D719,018 | S | 12/2014 | Levy et al. | |
| D764,279 | S | 8/2016 | Sevsek | |
| D805,894 | S | 12/2017 | Lee | |
| 10,654,610 | B2 | 5/2020 | Lee, Sr. | |
| 11,491,755 | B2 | 11/2022 | Walsh | |
| 2009/0233777 | A1 | 9/2009 | Greenfield | |
| 2012/0329627 | A1 | 12/2012 | Pettersson et al. | |
| 2014/0197230 | A1 | 7/2014 | Lopez Masague | |
| 2018/0297743 | A1 | 10/2018 | Greenfeld | |
| 2019/0276180 | A1 | 9/2019 | Zacherle | |
| 2020/0207506 | A1 | 7/2020 | Lopez Masague | |
| 2023/0075513 | A1 | 3/2023 | Myung et al. | |

OTHER PUBLICATIONS

Brown Printed Corrugated Box, posted at indiamart.com (date not available), [site visited Mar. 21, 2023]. Available from internet, URL: <https://www.indiamart.com/proddetail/brown-printed-corrugated-box-26750217162.html> (Year: NA), 2 pgs.

Nash, Zachery; Ex Parte Quayle Action for Design U.S. Appl. No. 29/744,815, filed Jul. 31, 2020, dated Mar. 31, 2023, 20 pgs.

Nash, Zachery; Notice of Allowance for Design U.S. Appl. No. 29/744,815, filed Jul. 31, 2020, dated Jan. 5, 2023, 5 pgs.

* cited by examiner

DOUBLE-HANDLE BOX

REFERENCE TO RELATED APPLICATIONS

This application claims the benefit of U.S. Provisional Application No. 63/089,824, filed Oct. 9, 2020, which is hereby specifically incorporated by reference herein in its entirety.

TECHNICAL FIELD

Field of Use

This disclosure relates to boxes. More specifically, this disclosure relates to boxes with panels defining handle openings in multiple adjacent panels that can be aligned which each other.

Related Art

Boxes are a ubiquitous form of portable storage. As such, they generally exist to both store and facilitate transport of their contents. While possessing the virtues of being relatively inexpensive, often biodegradable and recyclable, and generally storable in flattened form and yet also able to be formed into usable form by an untrained user, a typical box can also be uncomfortable or even difficult to carry and when heavily loaded can fail due to inadequate strength. When carrying a typical box, a user often has no choice but to support a bottom end of the box with open palms gripping a side of the box distal from the user and with sufficient pressure to maintain the user's grip. The accompanying extension of the arms and the posture of the hands and the rest of the body can physically tax the user. Even if a box has openings through which the user can grip a portion of the box other than by supporting the bottom end, such openings can be uncomfortable for the user and can "tear out" in such a way as to render the openings and, in some instances, the box useless.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

In one aspect, disclosed is a blank comprising a first side panel; a second side panel; a third side panel joining the first side panel and the second side panel and defining a first handle opening; a fourth side panel extending from the second side panel and defining a second handle opening; a plurality of bottom flaps, a first bottom flap, a second bottom flap, a third bottom flap, and a fourth bottom flap of the plurality of bottom flaps extending from the first side panel, the second side panel, the third side panel, and the fourth side panel, respectively; and a plurality of top flaps, a first top flap, a second top flap, a third top flap, and a fourth top flap of the plurality of the top flaps extending from the first side panel, the second side panel, the third side panel, and the fourth side panel, respectively; the third top flap defining a third handle opening and the fourth top flap defining a fourth handle opening, the third handle opening in the third top flap substantially aligned with the first handle opening in the third side panel when the third top flap is in a folded condition, and the fourth handle opening in the fourth top flap substantially aligned with the second handle opening in the fourth side panel when the fourth top flap is in a folded condition; wherein a centerline of the first handle opening is aligned with a centerline of the third handle opening, and wherein a centerline of the second handle opening is aligned with a centerline of the fourth handle opening.

Various implementations described in the present disclosure may comprise additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The accompanying drawings, which are incorporated in and constitute a part of this specification, illustrate several aspects of the disclosure and together with the description, serve to explain various principles of the disclosure. The drawings are not necessarily drawn to scale. Corresponding features and components throughout the figures may be designated by matching reference characters for the sake of consistency and clarity.

DETAILED DESCRIPTION

Figure 1:
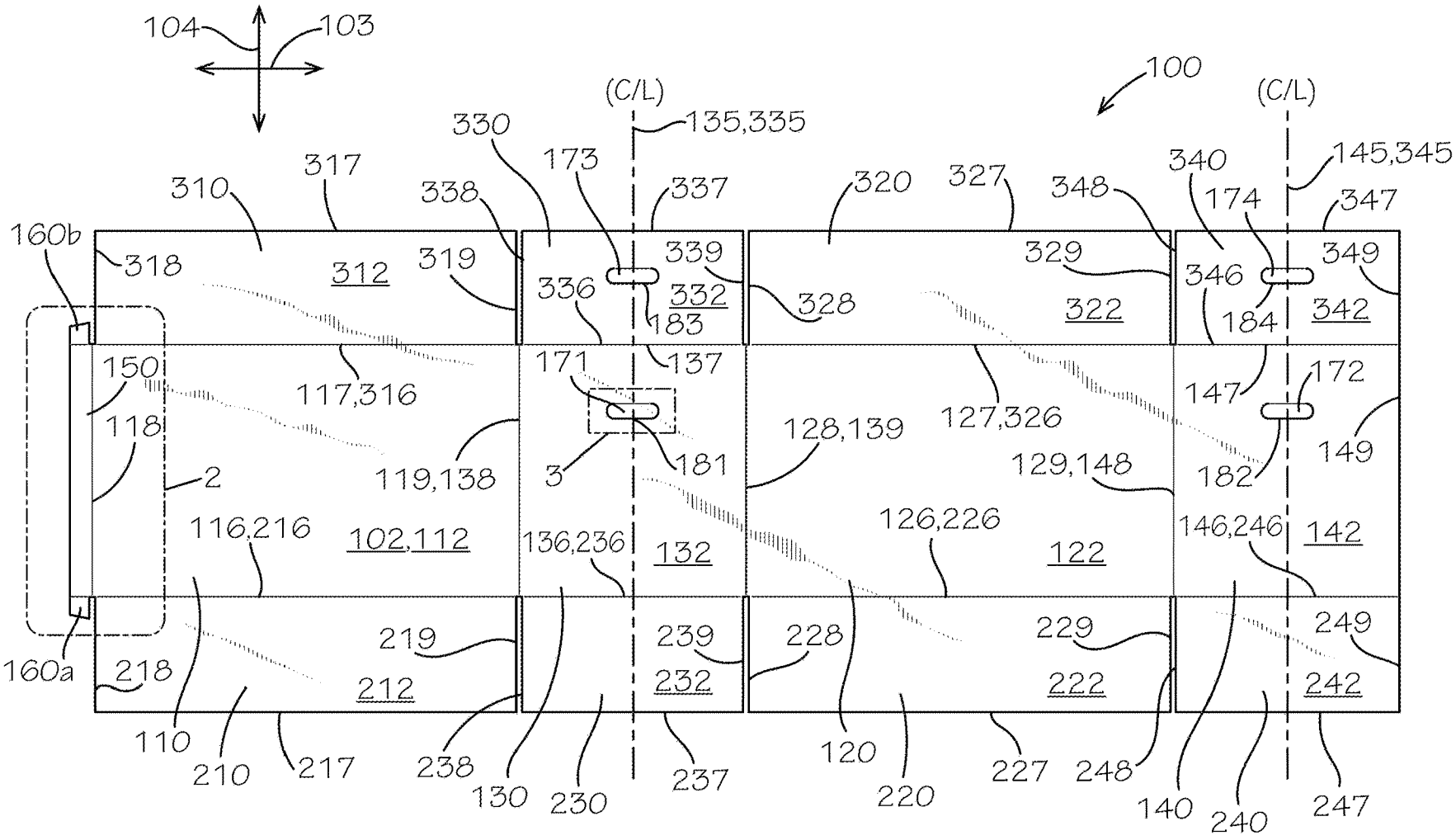
FIG. 1 is a top plan view of a blank for forming a box in accordance with one aspect of the current disclosure.

The present disclosure can be understood more readily by reference to the following detailed description, examples, drawings, and claims, and their previous and following description. However, before the present devices, systems, and/or methods are disclosed and described, it is to be understood that this disclosure is not limited to the specific devices, systems, and/or methods disclosed unless otherwise specified, as such can, of course, vary. It is also to be understood that the terminology used herein is for the purpose of describing particular aspects only and is not intended to be limiting.

The following description is provided as an enabling teaching of the present devices, systems, and/or methods in their best, currently known aspect. To this end, those skilled in the relevant art will recognize and appreciate that many changes can be made to the various aspects described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to a quantity of one of a particular element can comprise two or more such elements unless the context indicates otherwise. In addition, any of the elements described herein can be a first such element, a second such element, and so forth (e.g., a first widget and a second widget, even if only a "widget" is referenced).

Ranges can be expressed herein as from "about" one particular value, and/or to "about" another particular value. When such a range is expressed, another aspect comprises from the one particular value and/or to the other particular value. Similarly, when values are expressed as approximations, by use of the antecedent "about" or "substantially," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance may or may not occur, and that the description comprises instances where said event or circumstance occurs and instances where it does not.

The word "or" as used herein means any one member of a particular list and also comprises any combination of members of that list. The phrase "at least one of A and B" as used herein means "only A, only B, or both A and B"; while the phrase "one of A and B" means "A or B." The phrases "each of" and "each" as used herein to reference disclosed element(s) encompass any one or more or the recited elements (or instances of such elements) and can, but need not, encompass all of the recited elements (or instances of such elements).

To simplify the description of various elements disclosed herein, the conventions of "left," "right," "front," "rear," "top," "bottom," "upper," "lower," "inside," "outside," "inboard," "outboard," "horizontal," and/or "vertical" may be referenced. Unless stated otherwise, "front" describes that side or end of the box nearest to and occupied by a first side panel or front side panel of a box disclosed herein; "rear" is that side or end of the box that is opposite or distal the front; "left" is that which is to the left of or facing left from a person facing towards the front; and "right" is that which is to the right of or facing right from that same person while facing towards the front. "Horizontal" or "horizontal orientation" describes that which is in a plane extending from left to right and aligned with the horizon. "Vertical" or "vertical orientation" describes that which is in a plane that is angled at 90 degrees to the horizontal.

In one aspect, a box and associated methods, systems, devices, and various apparatuses are disclosed herein. In one aspect, the box can comprise at least two pairs of handle openings.

FIG. 1 is a top plan view of a blank 100 for forming a box 400 (shown in FIG. 4 in a partially assembled flattened condition and shown in FIG. 5 in an assembled and partially open position) in accordance with one aspect of the current disclosure. The blank 100 and the box 400 can comprise a plurality of side panels. More specifically, the blank 100 and the box 400 can comprise a first side panel 110, a second side panel 120, a third side panel 130, and a fourth side panel 140. The blank 100 can define an inner surface 101 (all shown in FIG. 12), which can comprise inner surfaces 111,121,131,141 (shown in FIG. 12) of the respective side panels 110,120,130,140. The blank 100 can define an outer surface 102, which can comprise outer surfaces 112,122, 132,142 of the respective side panels 110,120,130,140.

The first side panel 110 can, as described above, define the inner surface 111 and the outer surface 112. The first side panel 110 can define a bottom side end 116, a top side end 117, a first side end 118, and a second side end 119. Each of the first side end 118 and the second side end 119 can extend between and, in some aspects, also intersect the bottom side end 116 and the top side end 117.

The second side panel 120 can, as described above, define the inner surface 121 and the outer surface 122. The second side panel 120 can define a bottom side end 126, a top side end 127, a first side end 128, and a second side end 129. Each of the first side end 128 and the second side end 129 can extend between and, in some aspects, also intersect the bottom side end 126 and the top side end 127.

The third side panel 130 can join the second side end 119 of the first side panel 110 and the first side end 128 of the second side panel 120. The third side panel 130 can, as described above, define the inner surface 131 and the outer surface 132. The third side panel 130 can define a bottom side end 136, a top side end 137, a first side end 138, and a second side end 139. Each of the first side end 138 and the second side end 139 can extend between and, in some aspects, also intersect the bottom side end 136 and the top side end 137. The third side panel 130 can further comprise a first handle flap 171 and can define a first handle opening 181.

The fourth side panel 140 can join the second side end 129 of the second side panel 120 and the first side end 118 of the first side panel 110. The fourth side panel 140 can, as described above, define the inner surface 141 and the outer surface 142. The fourth side panel 140 can define a bottom side end 146, a top side end 147, a first side end 148, and a second side end 149. Each of the first side end 148 and the second side end 149 can extend between and, in some aspects, also intersect the bottom side end 146 and the top side end 147. The fourth side panel 140 can further comprise a second handle flap 172 and can further define a second handle opening 182.

The blank 100 and the box 400 can further comprise a plurality of bottom panels or bottom flaps, each of which can extend from one of the first side panel 110, the second side panel 120, the third side panel 130, and the fourth side panel 140. More specifically, the blank 100 and the box 400 can comprise a first bottom flap 210 extending from the first side panel 110, a second bottom flap 220 extending from the second side panel 120, a third bottom flap 230 extending from the third side panel 130, and a fourth bottom flap 240 extending from the fourth side panel 140.

The first bottom flap 210 can define an inner surface 211 (shown in FIG. 12) and an outer surface 212. The first bottom flap 210 can define an inside end 216, an outside end 217, a first side end 218, and a second side end 219. Each of the first side end 218 and the second side end 219 can extend between and, in some aspects, also intersect the inside end 216 and the outside end 217.

The second bottom flap 220 can define an inner surface 221 (shown in FIG. 12) and an outer surface 222. The second bottom flap 220 can define an inside end 226, an outside end 227, a first side end 228, and a second side end 229. Each of the first side end 228 and the second side end 229 can extend between and, in some aspects, also intersect the inside end 226 and the outside end 227.

The third bottom flap 230 can define an inner surface 231 (shown in FIG. 12) and an outer surface 232. The third bottom flap 230 can define an inside end 236, an outside end 237, a first side end 238, and a second side end 239. Each of the first side end 238 and the second side end 239 can extend between and, in some aspects, also intersect the inside end 236 and the outside end 237.

The fourth bottom flap 240 can define an inner surface 241 (shown in FIG. 12) and an outer surface 242. The fourth bottom flap 240 can define an inside end 246, an outside end 247, a first side end 248, and a second side end 249. Each of the first side end 248 and the second side end 249 can extend between and, in some aspects, also intersect the inside end 246 and the outside end 247.

The blank 100 and the box 400 can further comprise a plurality of top panels or top flaps, each of which can extend from one of the first side panel 110, the second side panel 120, the third side panel 130, and the fourth side panel 140. More specifically, the blank 100 and the box 400 can comprise a first top flap 310 extending from the first side panel 110, a second top flap 320 extending from the second side panel 120, a third top flap 330 extending from the third side panel 130, and a fourth top flap 340 the fourth side panel 140.

The first top flap 310 can define an inner surface 311 (shown in FIG. 12) and an outer surface 312. The first top flap 310 can define an inside end 316, an outside end 317, a first side end 318, and a second side end 319. Each of the first side end 318 and the second side end 319 can extend between and, in some aspects, also intersect the inside end 316 and the outside end 317.

The second top flap 320 can define an inner surface 321 (shown in FIG. 12) and an outer surface 322. The second top flap 320 can define an inside end 326, an outside end 327, a first side end 328, and a second side end 329. Each of the first side end 328 and the second side end 329 can extend between and, in some aspects, also intersect the inside end 326 and the outside end 327.

The third top flap 330 can define an inner surface 331 (shown in FIG. 12) and an outer surface 332. The third top flap 330 can define an inside end 336, an outside end 337, a first side end 338, and a second side end 339. Each of the first side end 338 and the second side end 339 can extend between and, in some aspects, also intersect the inside end 336 and the outside end 337. The third top flap 330 can further comprise a third handle flap 173 and can define a third handle opening 183.

The fourth top flap 340 can define an inner surface 341 (shown in FIG. 12) and an outer surface 342. The fourth top flap 340 can define an inside end 346, an outside end 347, a first side end 348, and a second side end 349. Each of the first side end 348 and the second side end 349 can extend between and, in some aspects, also intersect the inside end 346 and the outside end 347. The fourth top flap 340 can further comprise a fourth handle flap 174 and can further define a fourth handle opening 184.

As shown, the third handle flap 173 and the third handle opening 183 in the third top flap 330 can be substantially aligned with the first handle flap 171 and the first handle opening 181 in the third side panel 130. Similarly, the fourth handle flap 174 and the fourth handle opening 184 in the fourth top flap 340 can be substantially aligned with the second handle flap 172 and the second handle opening 182 in the fourth side panel 140. Moreover, each of the first handle opening 181, the second handle opening 182, the third handle opening 183, and the fourth handle opening 184 can be aligned with respective centerlines 135,145,335,345 of the third side panel 130, the fourth side panel 140, the third top flap 330, and the fourth top flap 340, respectively.

The blank 100 and the box 400 can comprise a connecting panel 150, which can extend from the first side panel 110 and can be configured to attach to the fourth side panel 140 to form the assembled box 400. In some aspects, the connecting panel 150 can be another side panel of the box 400 or can form a portion of one of the side panels or sides of the box 400. In some aspects, the connecting panel 150 can extend from any other side panel such as one of the side panels 120,130,140 and can extend between and join any two adjacent side panels of the side panels 110,120,130,140. The blank 100 and the box 400 can further comprise tab panels or tabs 160 such as, for example and without limitation, the tabs 160*a,b*. The tabs 160*a,b* can extend from the connecting panel 150. The connecting panel 150 and the tabs 160 will be described below in further detail.

As shown, any of the aforementioned panels can be joined to adjacent panels with or at bend lines defined by the intersections shown. Furthermore, any of the aforementioned panels can be a flange or a flap. Any of the aforementioned panels can further facilitate, for example and without limitation, rigidity of the box 400 and portions thereof by preventing or limiting deformation of neighboring panels loaded by a force resulting from a weight of contents of the box 400 or external forces applied thereto.

As shown, any of the aforementioned panels can define an exemplary radius, chamfer, or other corner treatment at intersecting ends, edges, or corners. Any of the aforementioned panels can be planar. Any of the aforementioned edges can be aligned with one of a longitudinal axis 103 and a transverse axis 104 of the blank 100. Any of the aforementioned features of the blank 100 can be symmetrical about the longitudinal axis 103 of the blank 100 or any portion thereof.

As shown, one or more edges or entire sides or even all sides of the blank 100 can be substantially aligned (i.e., aligned except for portions of such features defining insert tabs, corner radii or chamfers, and sloped or angled ends) or fully aligned, i.e., collinear. Such substantial alignment can improve utilization of material from which the blank 100 is cut or, in the case of full alignment, increase material utilization to near 100% not considering openings from which scrap material can be nonetheless cut and removed.

Figure 2:
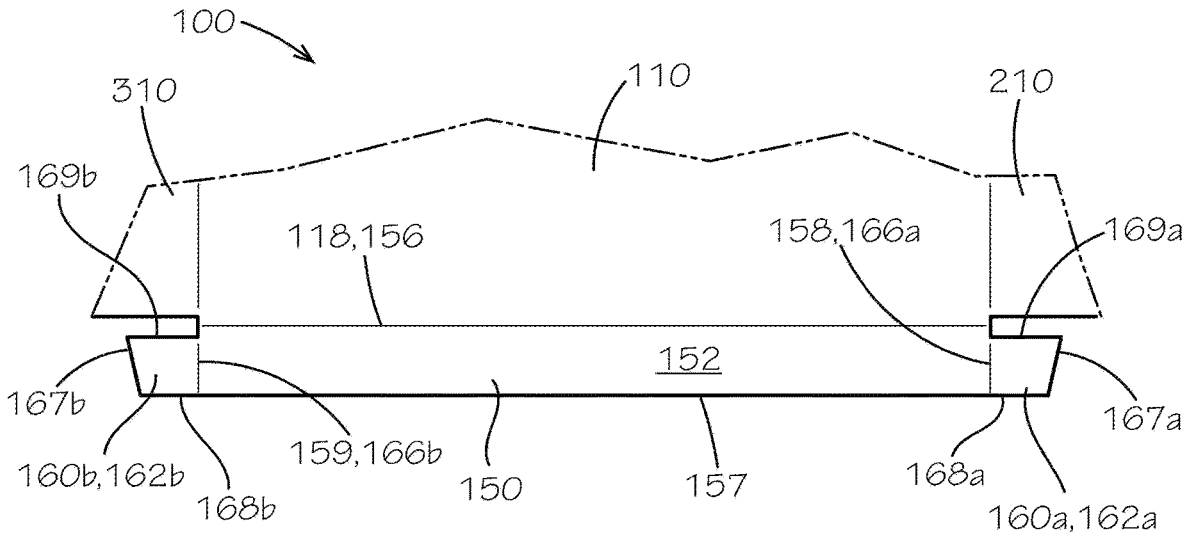
FIG. 2 is a detail view of a portion of the blank of FIG. 1 showing a connecting panel and tabs thereof taken from detail 2 of FIG. 1.

FIG. 2 is a detail view of a portion of the blank 100 showing the connecting panel 150 and the tabs 160*a,b*. Again, the connecting panel 150 can extend from the first side panel 110 and, more specifically, the first side end 118 of the first side panel 110. The connecting panel 150 can define an inner surface 151 (shown in FIG. 12) and an outer surface 152. The connecting panel 150 can define an inside end 156, an outside end 157, a first side end 158, and a second side end 159. Each of the first side end 158 and the second side end 159 can extend between and, in some aspects, also intersect the inside end 156 and the outside end 157.

The tab 160*a* can extend from the connecting panel 150 and, more specifically, the first side end 158 of the connecting panel 150. The tab 160*a* can define an inner surface 161*a* (shown in FIG. 12) and an outer surface 162*a*. The tab 160*a* can define an inside end 166*a*, an outside end 167*a*, a first side end 168*a*, and a second side end 169*a*. Each of the first side end 168*a* and the second side end 169*a* can extend between and, in some aspects, also intersect the inside end 166*a* and the outside end 167*a*. The tab 160*a* can extend from the connecting panel 150 in the same direction as each of the top flaps 310,320,330,340 extends from the respective side panels 110,120,130,140.

The tab 160*b* can extend from the connecting panel 150 and, more specifically, the second side end 159 of the connecting panel 150. The tab 160*b* can define an inner surface 161*b* (shown in FIG. 12) and an outer surface 162*b*. The tab 160*b* can define an inside end 166*b*, an outside end 167*b*, a first side end 168*b*, and a second side end 169*b*. Each of the first side end 168*b* and the second side end 169*b* can extend between and, in some aspects, also intersect the inside end 166*b* and the outside end 167*b*. The tab 160*b* can extend from the connecting panel 150 in the same direction as each of the bottom flaps 210,220,230,240 extends from the respective side panels 110,120,130,140. The tab 160*a* and the tab 160*b* can extend from the connecting panel 150 in opposite directions. In some aspects, not considering the presence of the handle openings 181,182,183,184, the blank 100 can be symmetric about a longitudinal centerline of the box (not shown) bisecting each of the side panels 110,120, 130,140.

Figure 3:
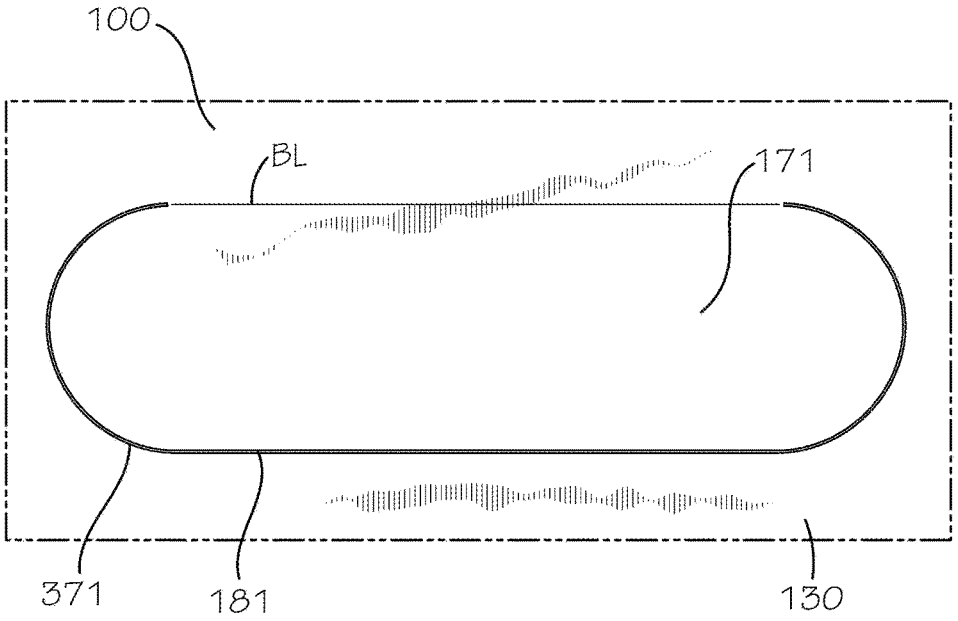
FIG. 3 is a detail view of a handle opening of a box formed from the blank of FIG. 1 taken from detail 3 of FIG. 1.

FIG. 3 is a plan view of the handle flap 171 and the handle opening 181 of the blank 100 and the box 400 (shown in FIG. 4) taken from detail 2 of FIG. 1. The handle flap 171, which can define an edge 371 and a bend line BL, can be representative of the handle flaps 172,173,174 (shown in FIG. 1). Similarly, the handle opening 181 can be representative of the handle openings 182,183,184 (shown in FIG. 1).

Figure 4:
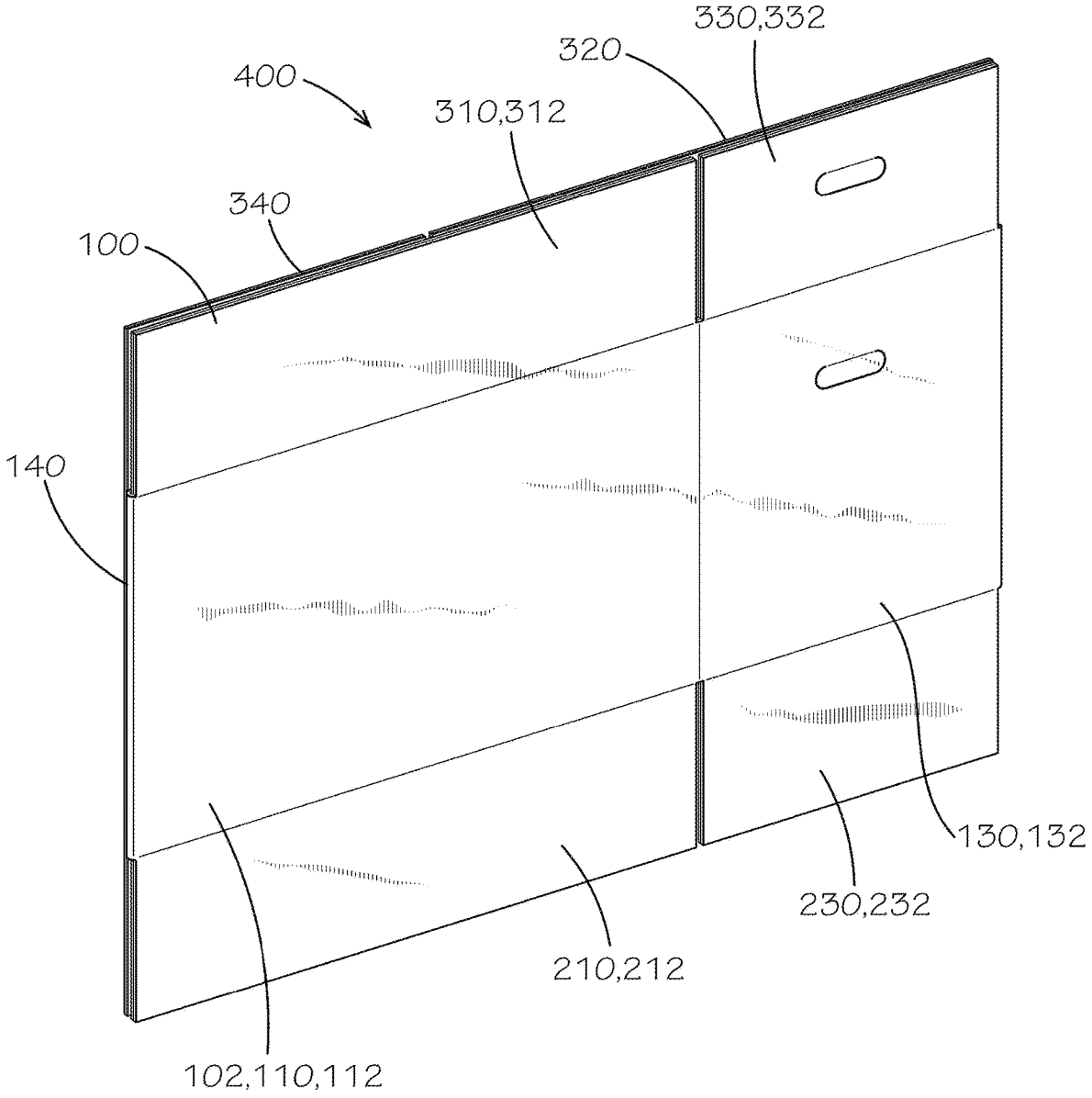
FIG. 4 is a perspective view of the box of FIG. 1 in a partially assembled flattened condition.

FIG. 4 is a perspective view of the box 400 in a partially assembled flattened condition. As shown, the connecting panel 150 (shown in FIG. 1) can be joined to the fourth side panel 140. More specifically, the outer surface 152 (shown in FIG. 2) of the connecting panel 150 can be placed in mating contact with the inner surface 141 (shown in FIG. 12) of the fourth side panel 140. In some aspects, a fastener such as an adhesive material can be used to join the connecting panel 150 and the fourth side panel 140. In some aspects, a mechanical fastener such as, for example and without limitation, a staple can be used to join the connecting panel 150 and the fourth side panel 140. In the partially assembled flattened condition shown, various portions of the inner surface 101 (shown in FIG. 12) can face each other and, in a completely flattened condition, can be parallel or substantially parallel to each other.

Figure 5:
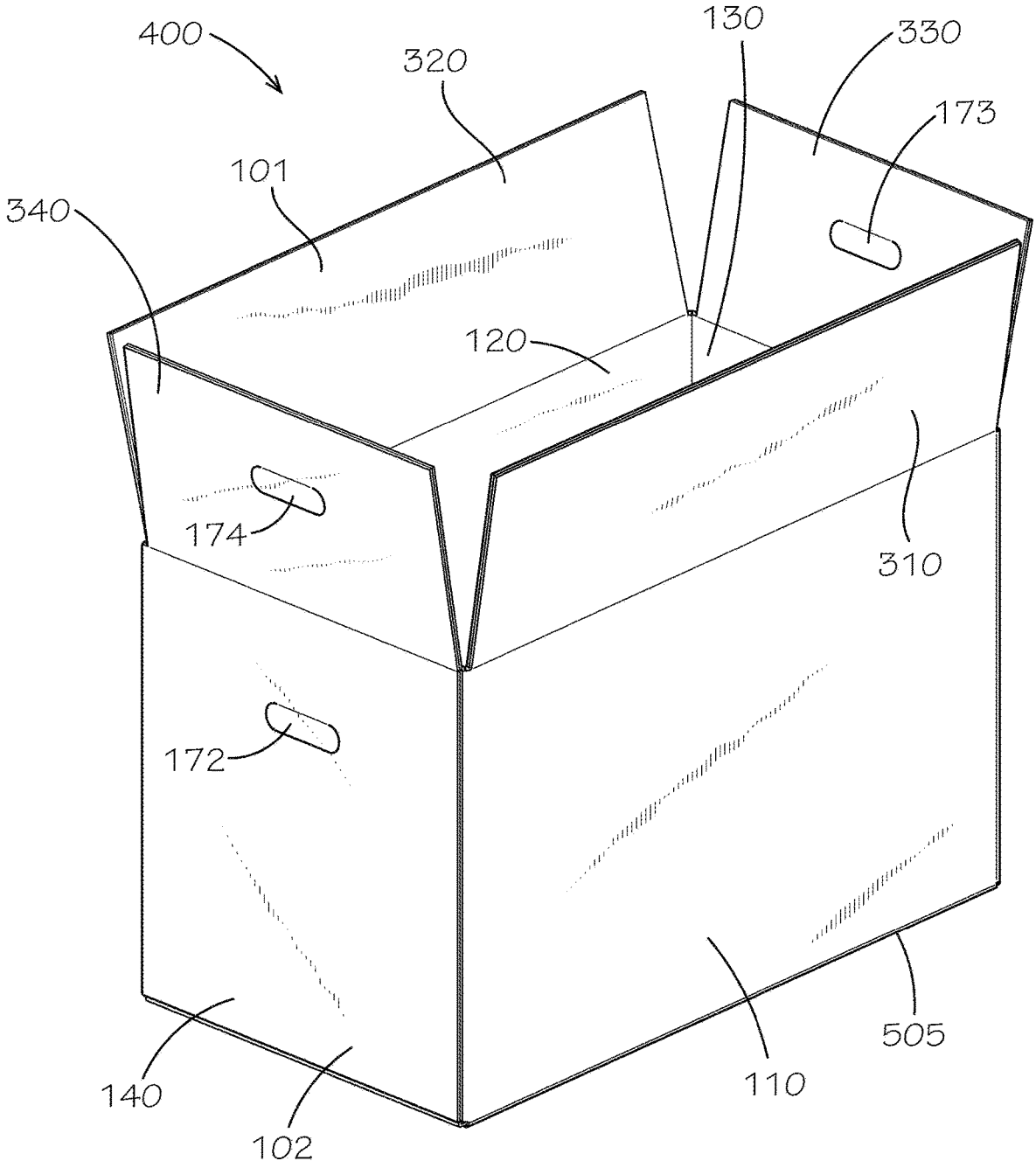
FIG. 5 is a perspective view of the box of FIG. 1 in an assembled and partially open position.

FIG. 5 is a perspective view of the box 400 in an assembled and partially open position. As shown, the box 400 can defined a formed bottom end 505.

Figure 6:
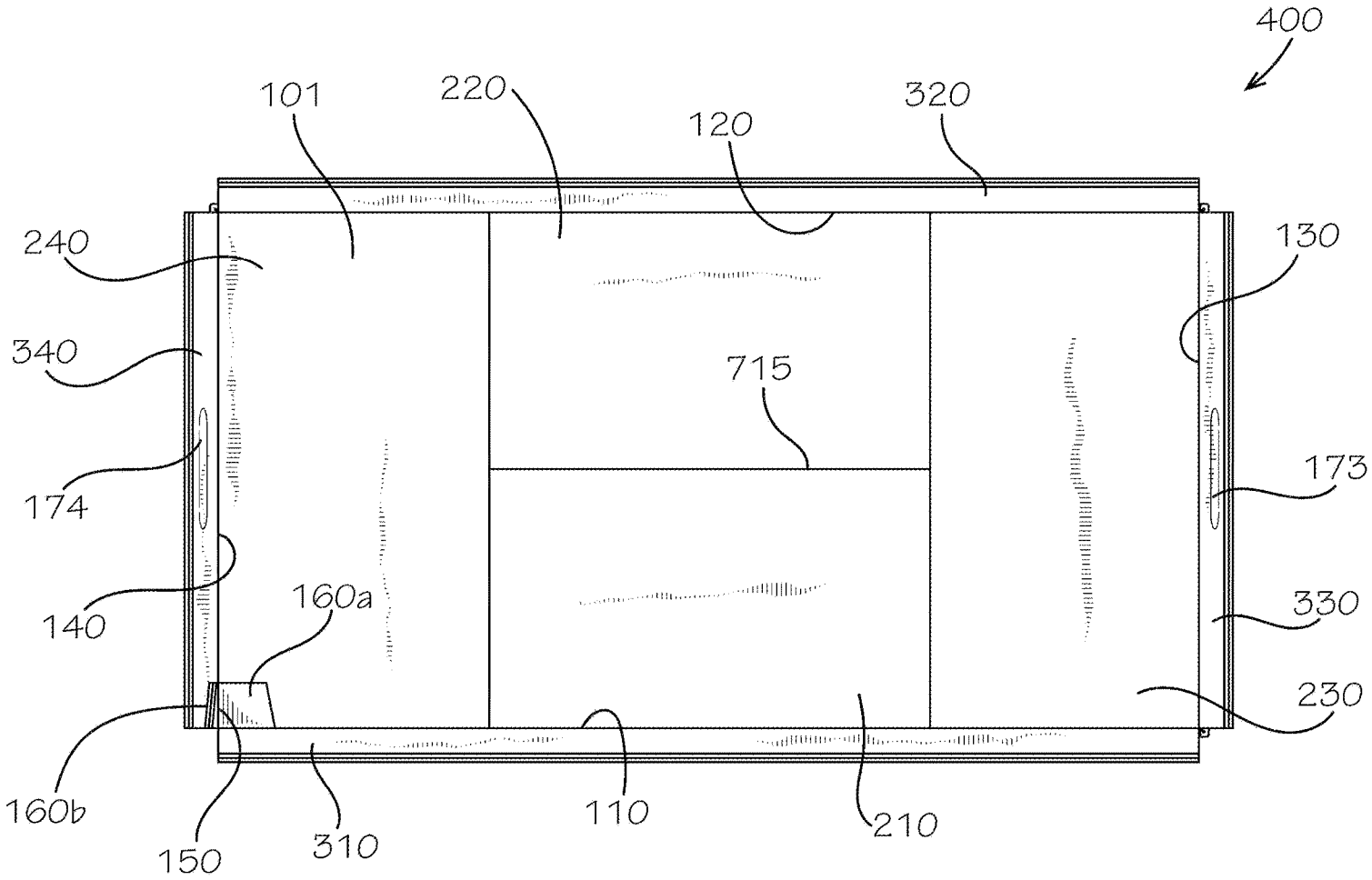
FIG. 6 is a top plan view of the box of FIG. 1 in the assembled and partially open position.
Figure 7:
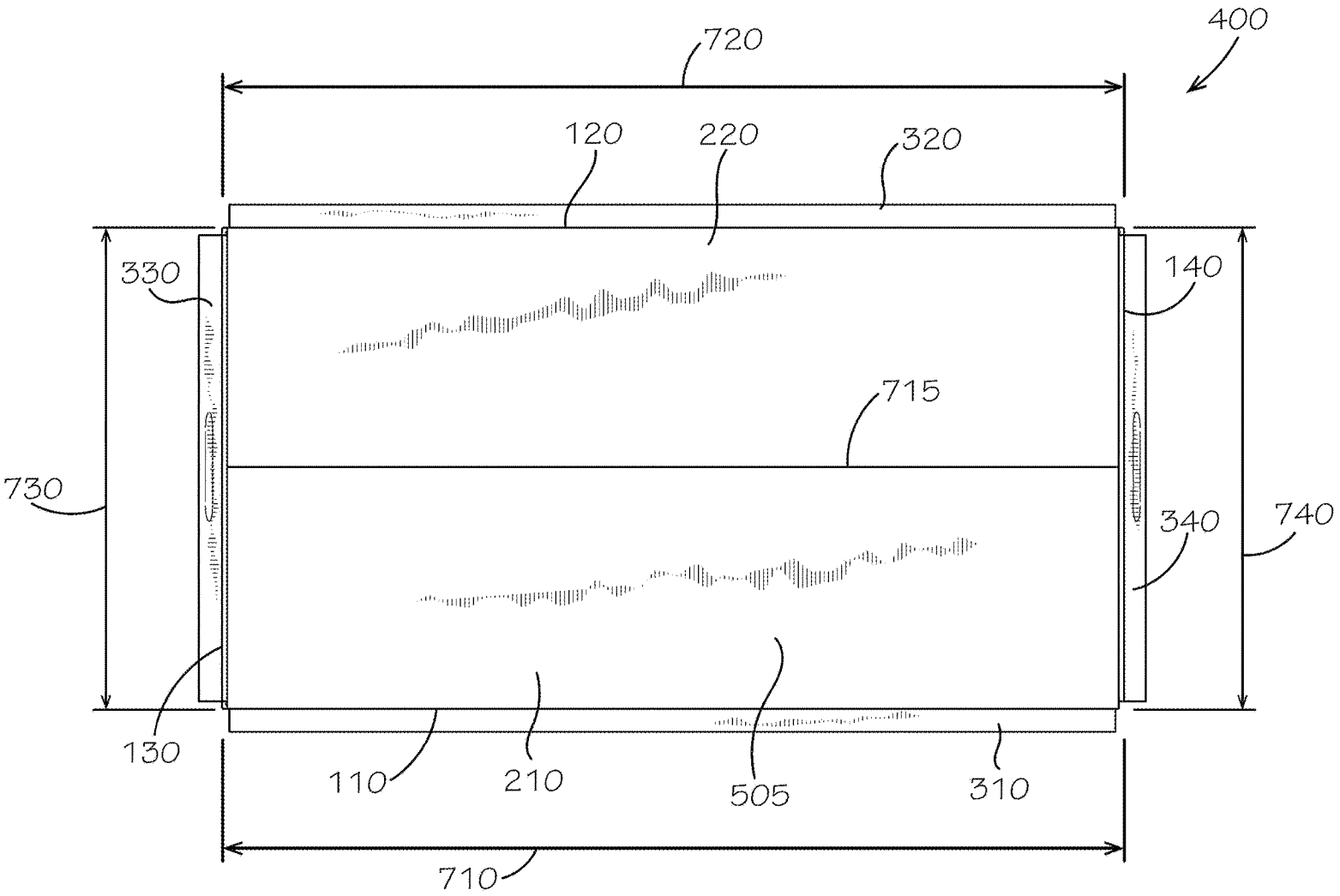
FIG. 7 is a bottom plan view of the box of FIG. 1 in the assembled and partially open position.

FIG. 6 is a top plan view and FIG. 7 is a bottom plan view of the box 400. As shown, the bottom flaps 210,220,230,240 can be folded inwardly towards each other such that the formed bottom end 505 (shown in FIG. 7) of the box 400 is closed, i.e., formed without open gaps. More specifically, the bottom flaps 210,220 can define a seam 715, which can be a closed seam, i.e., a seam without an open gap. In plan view, the box 400 can define a rectangular shape. More specifically, in some aspects, respective widths 710,720 (shown in FIG. 7) of the first side panel 110 and the second side panel 120 can be greater than respective widths 730,740 (shown in FIG. 7) of the third side panel 130 and the fourth side panel 140.

Figure 8:
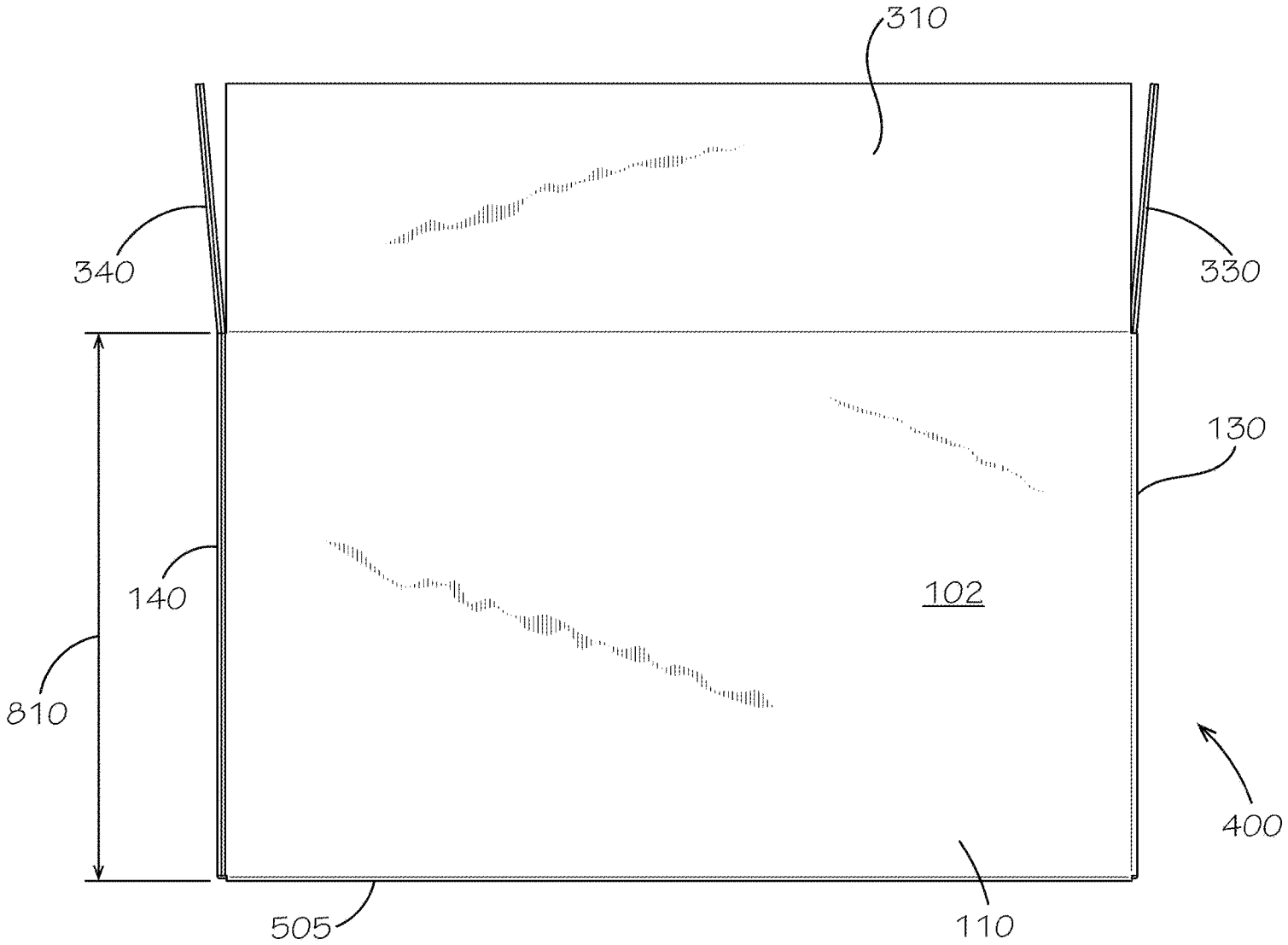
FIG. 8 is a front elevation view of the box of FIG. 1 in the assembled and partially open position showing a first side panel of the box.
Figure 9:
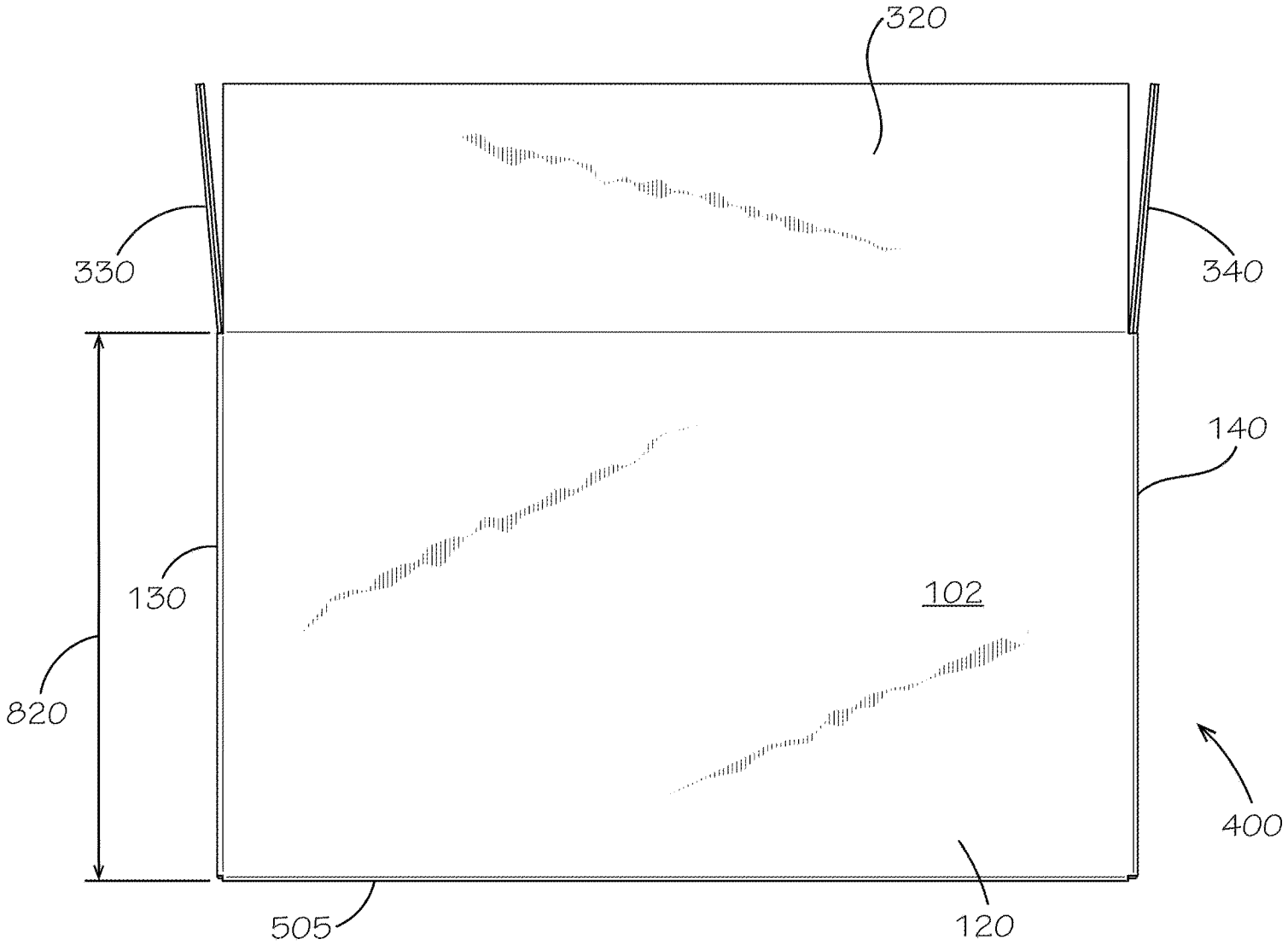
FIG. 9 is a rear elevation view of the box of FIG. 1 in the assembled and partially open position showing a second side panel of the box.

FIG. 8 is a front elevation view of the box 400 showing the first side panel 110, and FIG. 9 is a rear elevation view of the box 400 showing the second side panel 120 of the box 400. In elevation view, the box 400 can define a rectangular shape. More specifically, in some aspects, the width 710 (shown in FIG. 7) of the first side panel 110 can be greater than a corresponding height 810 of the first side panel 110. Similarly, the width 720 (shown in FIG. 7) of the second side panel 120 can be greater than a corresponding height 820 of the second side panel 120.

Figure 11:
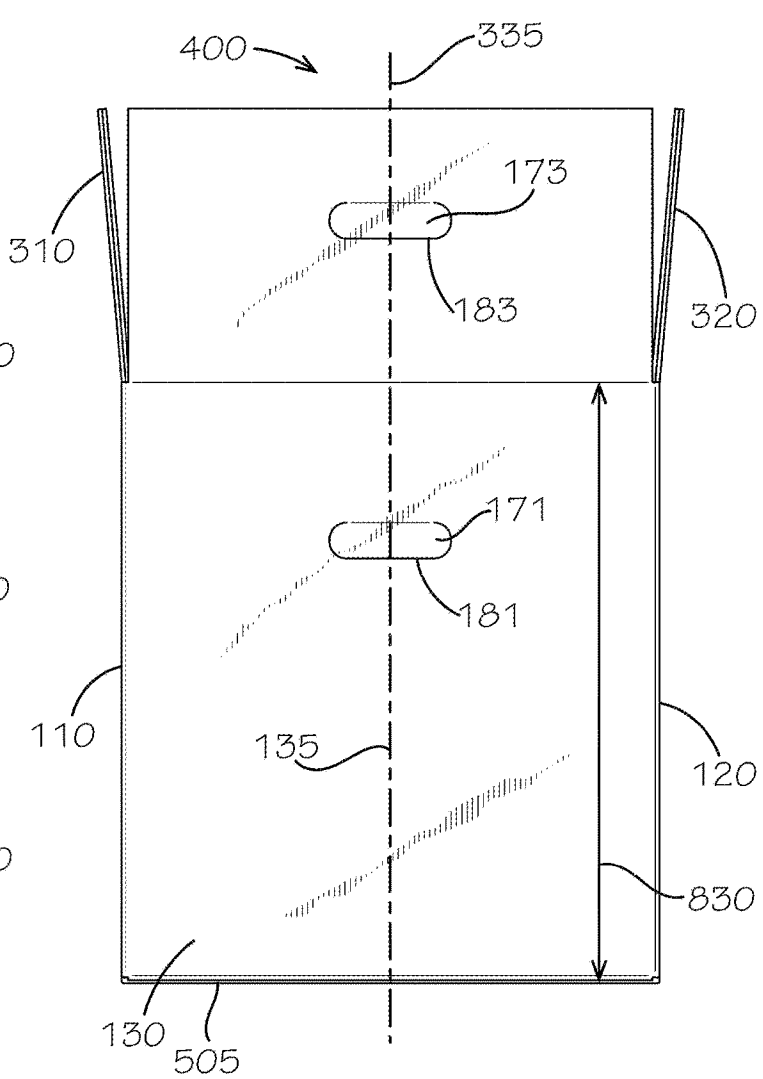
FIG. 11 is a second side or right side elevation view of the box of FIG. 1 in the assembled and partially open position showing a third side panel of the box.
Figure 10:
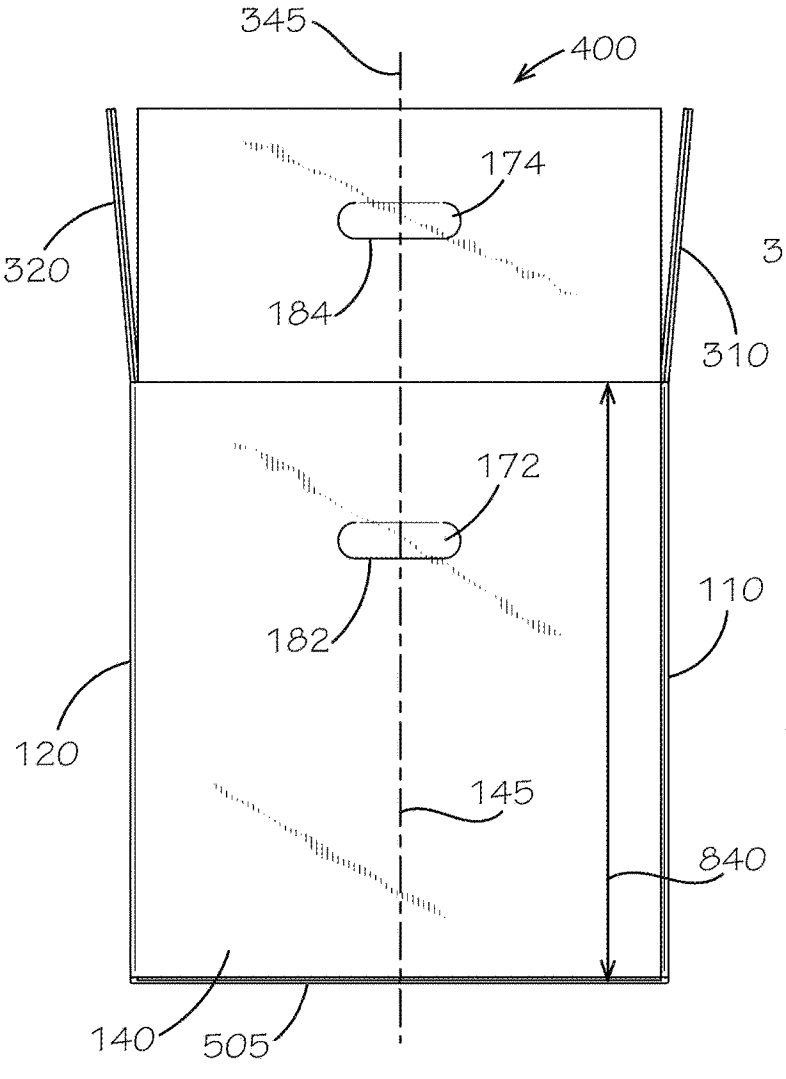
FIG. 10 is a first side or left side elevation view of the box of FIG. 1 in the assembled and partially open position showing a fourth side panel of the box.

FIG. 10 is a first side or left side elevation view of the box 400 showing the fourth side panel 140 of the box 400, and FIG. 11 is a second side or right side elevation view of the box 400 showing the third side panel 130 of the box 400. The centerlines 135,145,335,345 can be centerlines of the respective side panels 130,140 and the respective top flaps 330,340 as shown in FIG. 1 or can be centerlines of the respective sides of the box 400 in an assembled condition such as shown in respective FIGS. 10 and 11. In the elevation views shown, the box 400 can define a rectangular shape. More specifically, in some aspects, a width 740 (shown in FIG. 7) of the fourth side panel 140 can be less than a corresponding height 840 (shown in FIG. 11) of the fourth side panel 140. Similarly, a width 730 (shown in FIG.

7) of the third side panel 130 (shown in FIG. 11) can be less than a corresponding height 830 (shown in FIG. 11) of the third side panel 130.

Figure 12:
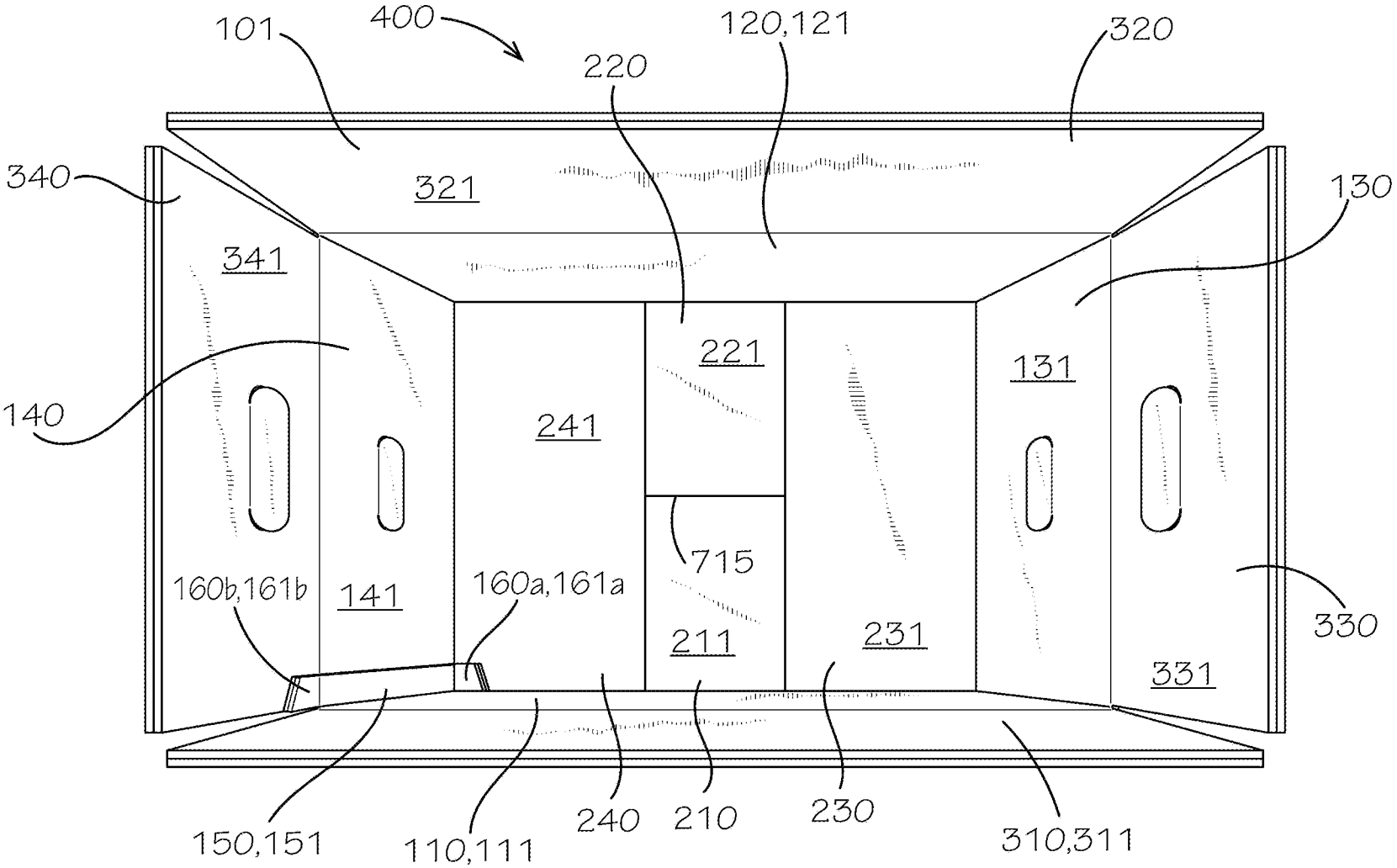
FIG. 12 is a top perspective view of the box of FIG. 1 in the assembled and partially open position.

FIG. 12 is a top perspective view of the box 400 showing the inner surface 101 of the blank 100 (shown in FIG. 1) and, more specifically, the respective inner surfaces 111,121,131, 141 of the side panels 110,120,130,140, the respective inner surfaces 211,221,231,241 of the bottom flaps 210,220,230, 240, the respective inner surfaces 311,321,331,341 of the top flaps 310,320,330,340, the inner surface 151 of the connecting panel 150, and the respective inner surfaces of the tabs 160*a,b*.

Figure 13:
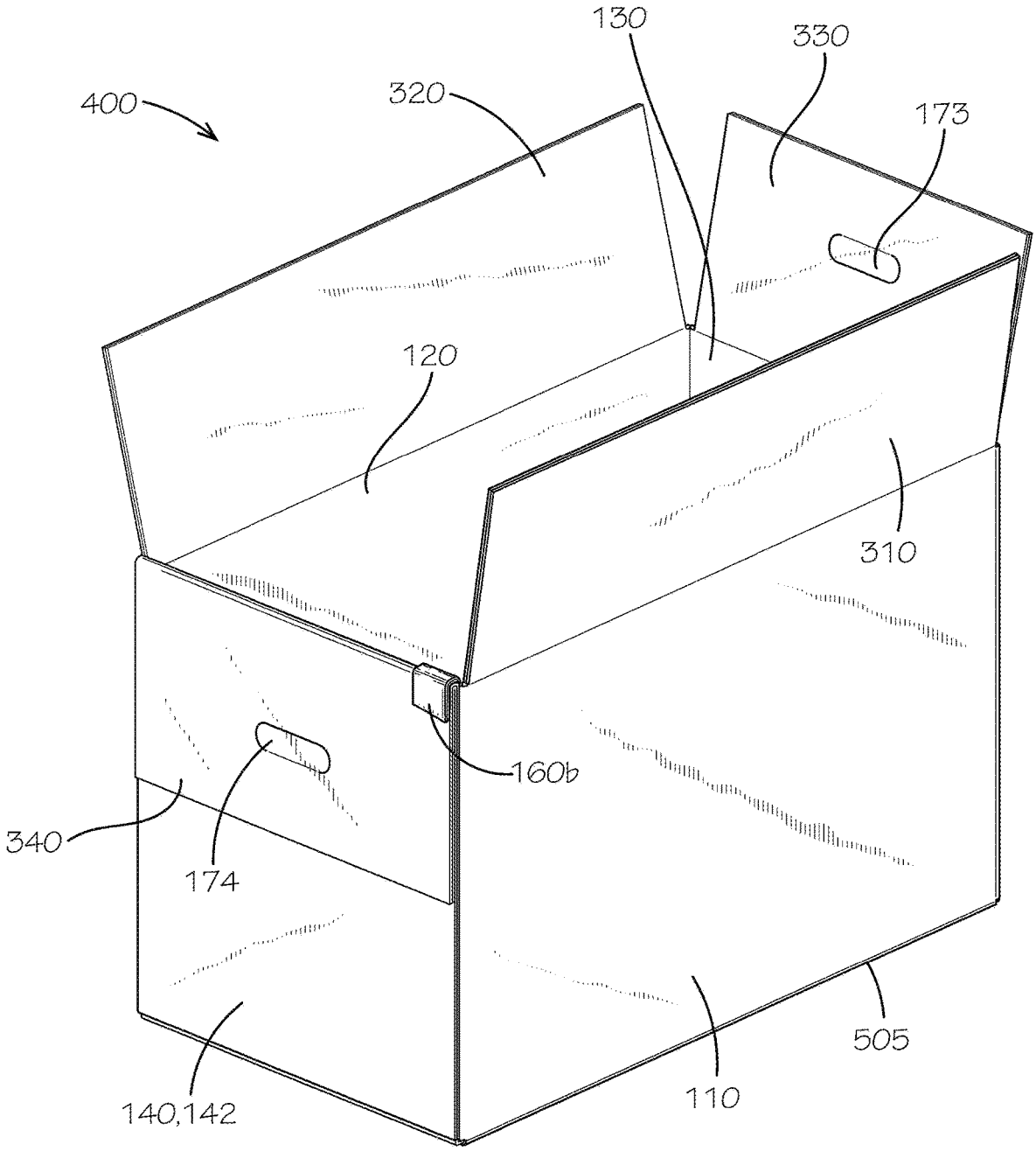
FIG. 13 is a perspective view of the box of FIG. 1 in the assembled and partially open position but showing a top flap thereof bent fully outward.

FIG. 13 is a perspective view of the box 400 of FIG. 1 showing a top flap thereof—more specifically, the top flap 340—bent fully outward. As shown, the tab 160*b* can be attached and remain secured to the top flap 340 such that bending of the top flap 340 will cause bending of the tab 160*b*. Similarly, as shown in FIG. 12, the tab 160*a* (shown in FIG. 1) can be attached and remain secured to the bottom flap 240 such that bending of the bottom flap 240 will cause bending of the tab 160*a* (as shown in FIGS. 6 and 12). As also shown, the top flap 340 (and, similarly, the top flap 330) can be bent 180 degrees from its original position in the blank 100 to a position outside (or inside) the fourth side panel 140 (or, in the case of the top flap 330, the third side panel 130). In such a bent condition, the outer surface 342 (shown in FIG. 1) of the top flap 340 can face and can contact the outer surface 142 of the fourth side panel 140. In such a bent condition, the outer surface 332 (shown in FIG. 1) of the top flap 330 can similarly face and can contact the outer surface 132 (shown in FIG. 1) of the third side panel 130.

Figure 14:
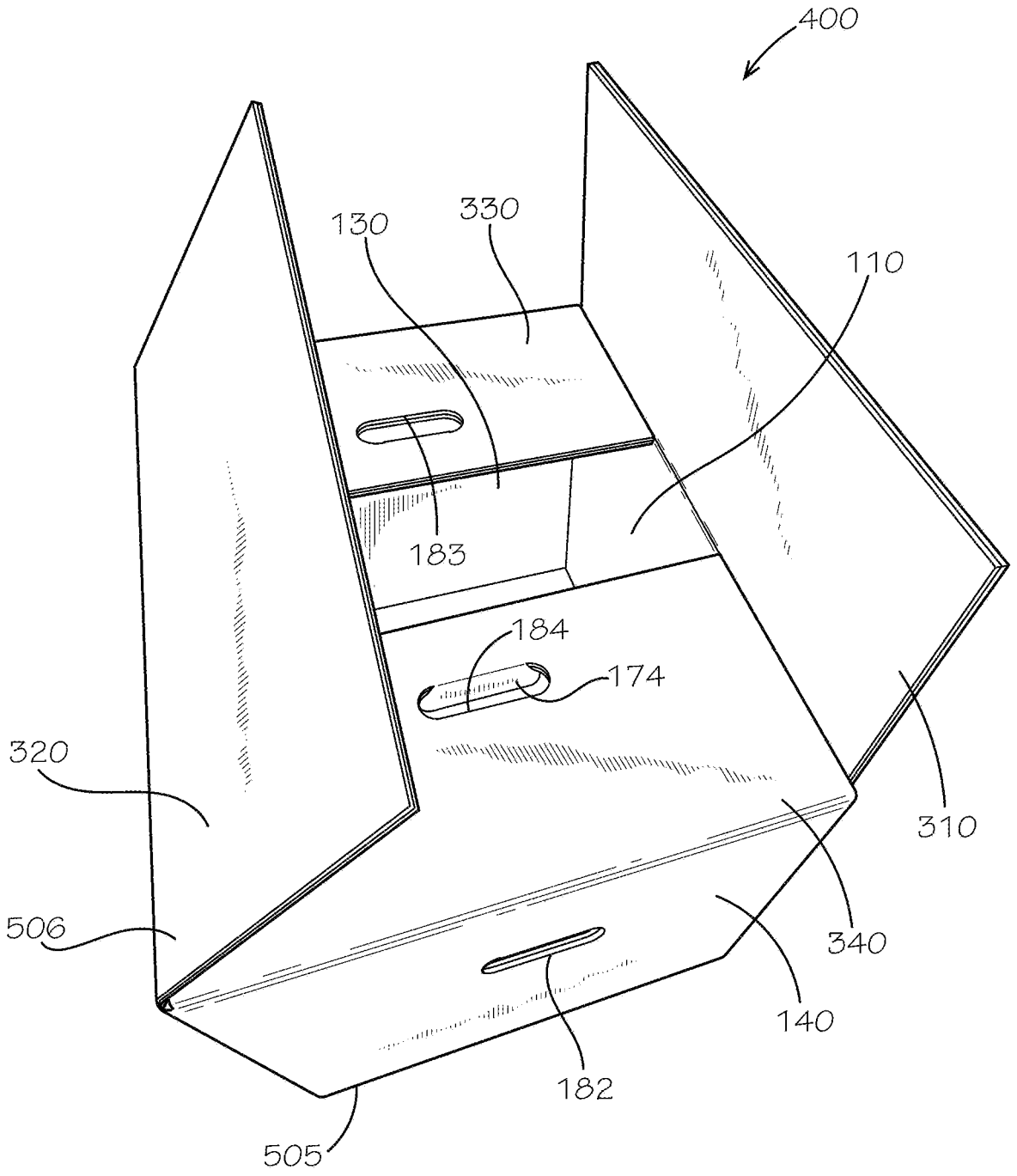
FIG. 14 is a right top perspective view of the box of FIG. 1 showing third and fourth top flaps thereof bent inward and first and second top flaps thereof bent partially inward.

FIG. 14 is a right top perspective view of the box 400 showing the third top flap 330 and the fourth top flap 340 thereof bent inward (and, more specifically, bent at approximately 90 degrees with respect to their positions in a flattened configuration) and the first top flap 310 and the second top flap 320 thereof bent partially inward. By bending each of the top flaps 310,320,330,340 by approximately 90 degrees inward, the box 400 can be closed to form a formed top end 506 positioned distal from the bottom end 505 of the box 400.

Figure 15:
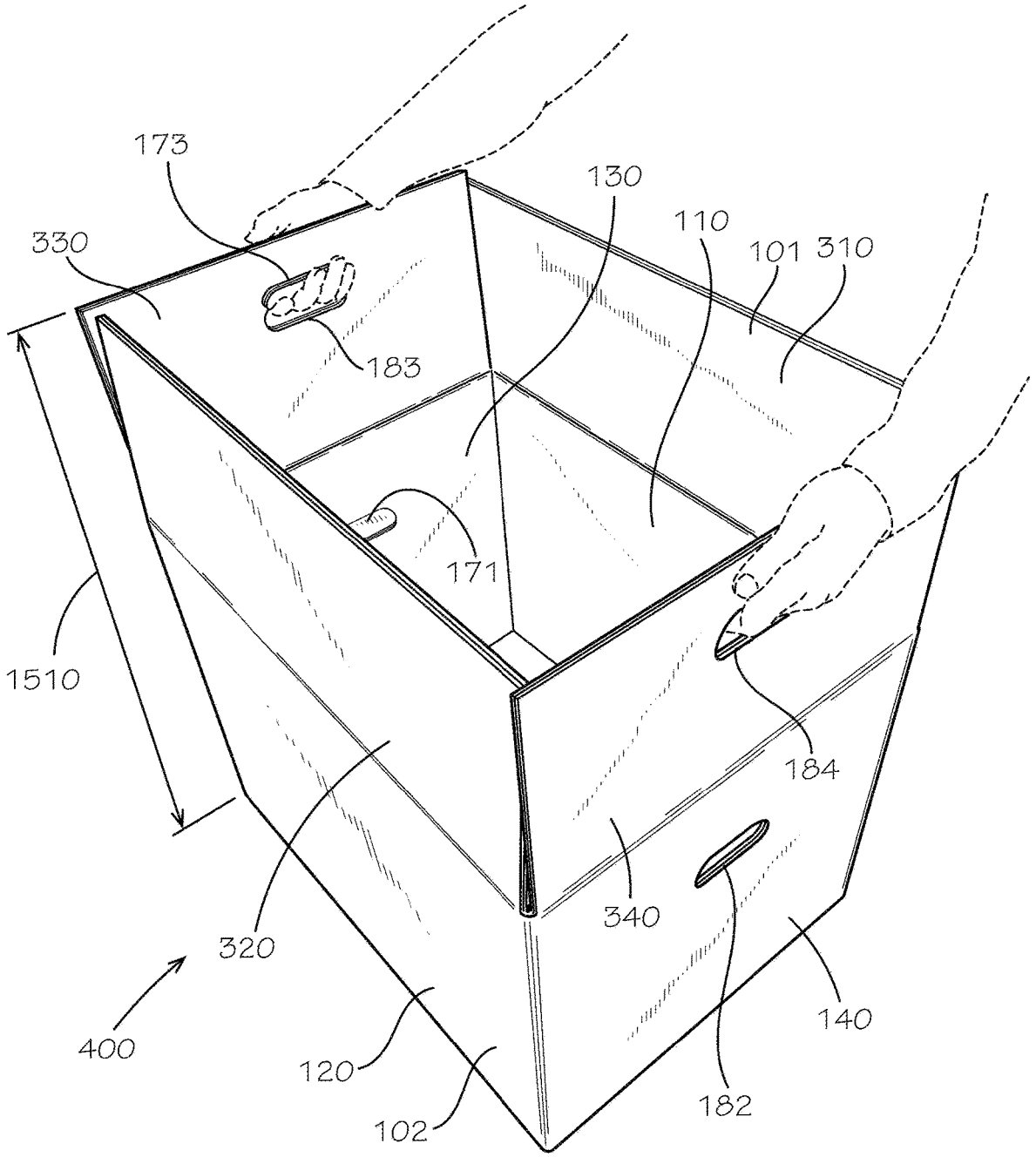
FIG. 15 is a perspective view of the box of FIG. 1 showing the two top flaps of FIG. 14 and a user of the box holding the box by gripping a handle opening in each of the two top flaps.

FIG. 15 is a perspective view of the box 400 showing a user of the box 400 holding the box 400 by gripping the handle openings 183,184 defined in the respective top flaps 330,340. As shown, fingers of each hand of the user can extend through the handle openings 183,184 and wrap around the handle openings 183,184 and, if present, the handle flaps 173,174 (174 shown in FIG. 1). By holding the box 400 as shown, an effective volume of the box can be increased because of an effective height 1510 of the box 400 being higher or taller than the heights 810,820,830,840 (810 shown in FIG. 8, 820 shown in FIG. 9, 830 shown in FIG. 11, and 840 shown in FIG. 10). As shown, the handle flaps 173,174 can be folded by as much 180 degrees inward, i.e., towards an interior cavity of the box 400 and against or facing the inner surface 101 of the box 400 (or, in other aspects, outward away from the interior cavity and against or facing the outer surface 102 of the box 400). Folding the handle flap 173,174 can open up the corresponding handle opening 183,184 to receive a hand of the user. Folding the handle flap 173,174 can also create a smooth rounded grip formed at the bend line BL (shown in FIG. 3) by the material forming the handle flap 173,174. Such a smooth, rounded grip can increase user comfort—especially when carrying a loaded box 400 that is heavy.

Figure 16:
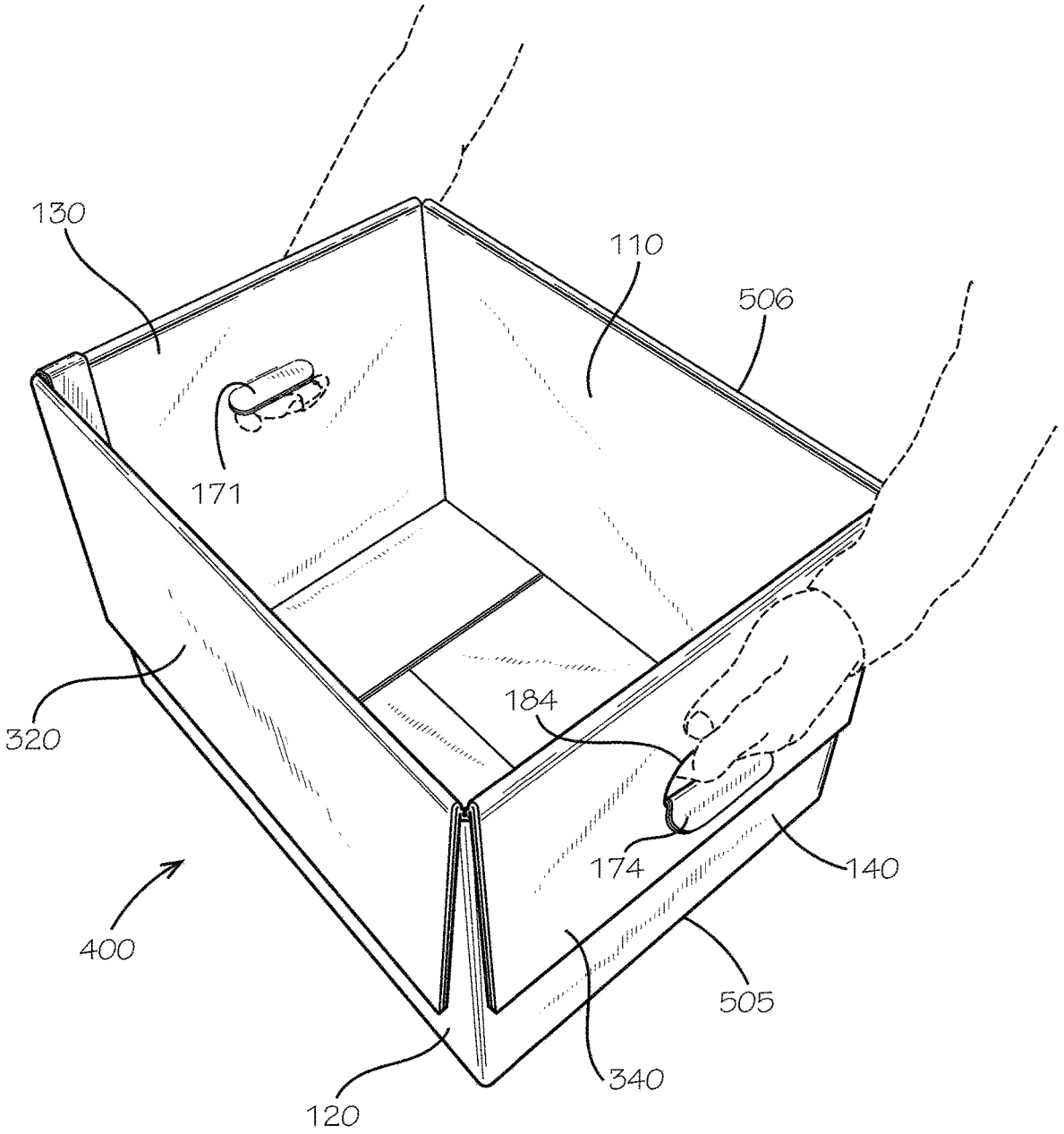
FIG. 16 is a perspective view of the box of FIG. 1 showing a user of the box holding the box by simultaneously gripping a handle opening in each of the third top flap and the fourth top flap of FIG. 14 while they are bent fully outward as well as gripping a handle opening in each of two side panels of the box.

FIG. 16 is a perspective view of the box 400 showing a user of the box 400 holding the box 400 by simultaneously gripping the handle openings 181,182 (shown in FIG. 1) in the respective side panels 130,140 and also the handle openings 183,184 (both shown in FIG. 15) in the respective top flaps 330,340 (330 shown in FIG. 1). As shown, the top flaps 330,340 can be bent fully outward. As shown, the handle flaps 171,172 (172 shown in FIG. 1) can be folded by as much 180 degrees inward, i.e., towards an interior cavity of the box 400 (or outward away from the interior cavity). Folding the handle flap 171,172 can open up the corresponding handle opening 181,182 to receive a hand of the user. Folding the handle flap 171,172 can also create a smooth rounded grip formed at the bend line BL by the material forming the handle flap 171,172 (shown in FIG. 3). Such a smooth, rounded grip can increase user comfort—especially when carrying a loaded box 400 that is heavy.

The blank 100 and the box 400 and any portion thereof can be formed from a cardboard material such as, for example and without limitation, corrugated cardboard or plastic. In some aspects, the blank 100 and the box 400 can be formed from any corrugated material including micro flutes and larger flutes including, for example and without limitation, "A" flute material. More specifically, the blank 100 and the box 400 can be formed from any range of materials including an "F" flute or less (defining a nominal thickness of 1/32 inch or 0.8 mm), an "E" flute or less (defining a nominal thickness of 1/16 inch or 01.6 mm), a "B" flute or less (defining a nominal thickness of 1/8 inch or 3.2 mm), or an "A" flute or less (defining a nominal thickness of 3/16 inch or 4.8 mm) specification. In some aspects, as shown, the blank 100 and the box 400 can be formed from a double-wall material or other multi-wall or multi-ply material. In some aspects, the blank 100 and the box 400 can be formed from a single-wall or single-ply material. In some aspects, as shown, the blank 100 and the box 400 can be formed from the aforementioned corrugated material. In some aspects, the blank 100 and the box 400 can be formed from non-corrugated material.

As shown throughout, the blank 100 and the box 400 or any portion thereof can be formed from a corrugated material such as corrugated cardboard or plastic. In some aspects, the blank 100 and the box 400 or any portion thereof can be formed from a single wall material. In some aspects, the blank 100 and the box 400 or any portion thereof can be formed from a double-wall material. The material forming the blank 100 and the box 400 can be sufficiently strong to permit lifting of the box 400 at the handle openings 181, 182,183,184 without tearing out the respective side panels 110,120,130,140 or the respective top flaps 310,320,330, 340.

A method of forming the blank 100 can comprise using a tool to form edges of each of the panels disclosed. Such a tool can form the blank 100 in an automated process.

A method of assembling the box 400 can comprise joining the first side panel 110 and the fourth side panel 140. In some aspects, joining the first side panel 110 and the fourth side panel 140 can comprise joining the first side panel 110 and the fourth side panel 140 with the connecting panel 150, which can extend from a one of the first side panel 110 and the fourth side panel 140. Again, in some aspects, the method of assembling the box 400 can comprise joining any adjacent side panels with the connecting panel 150, which can extend from either of the adjacent side panels.

A method of using the box 400 can comprise obtaining the box 400. The method can comprise orienting the box 400 such that the bottom end 505 is facing down and the top end 506 is facing up and the handle openings 181,182,183,184 are facing to the side. The method can comprise placing one or more items into the box 400. The method can comprise folding one, two, three, or four of the top flaps 310,320, 330,340 inward or outward so that the one, two, three, or four of the top flaps 310,320,330,340 are facing the corresponding side panels 110,120,130,140. In some aspects, folding the one, two, three, or four of the top flaps 310,320, 330,340 inward or outward can comprise contacting the corresponding side panels 110,120,130,140 with the top flaps 310,320,330,340. The method can comprise inserting a hand of a user into at least two of the first handle opening 181, the second handle opening 182, the third handle opening 183, and the fourth handle opening 184. The method can comprise a first hand of the user extending through and gripping or wrapping around both of the handle openings 181,183 and a second hand of the user extending through and gripping or wrapping around both of the handle openings 182,184. In some aspects, gripping both of the handle openings 181,183 and gripping both of the handle openings 182,184 can, respectively, comprise simultaneously gripping both of the handle openings 181,183 and gripping both of the handle openings 182,184. The method can comprise lifting the box 400 in a vertically upward direction through only an upward force applied by the hands of the user at the handle openings 181,182,183,184.

Any feature described herein such as, for example and without limitation, the handle openings 181,182,183,184, the handle flaps 171,172,173,174, and other components of the blank 100 or the box 400 and their arrangement, can comprise both functional and aesthetic elements, and any feature described as having functional aspects can have or define any one of several aesthetic designs without altering the respective parts' functions. If aesthetic elements are shown in the drawings or possibly fall within the scope of broader claim elements without being directly claimed, such disclosure or claims should not be interpreted as assigning any function to such aesthetic elements which may therefore be separately protectable.

One should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily comprise logic for deciding, with or without user input or prompting, whether these features, elements and/or steps are included or are to be performed in any particular aspect.

It should be emphasized that the above-described aspects are merely possible examples of implementations, merely set forth for a clear understanding of the principles of the present disclosure. Any process descriptions or blocks in flow diagrams should be understood as representing modules, segments, or portions of code which comprise one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described aspect(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A box comprising:

a first side panel defining a top side end, a bottom side end, a first side end, and a second side end, each of the first side end and the second side end extending between and intersecting the top side end and the bottom side end;

a second side panel defining a top side end, a bottom side end, a first side end, and a second side end, each of the first side end of the second side panel and the second side end of the second side panel extending between and intersecting the top side end of the second side panel and the bottom side end of the second side panel;

a third side panel joining the second side end of the first side panel and the first side end of the second side panel and defining a first handle opening, the third side panel defining a top side end, a bottom side end, a first side end, and a second side end, each of the first side end of the third side panel and the second side end of the third side panel extending between and intersecting the top side end of the third side panel and the bottom side end of the third side panel;

a fourth side panel extending from the second side end of the second side panel and defining a second handle opening, the fourth side panel extending from the second side end of the second side, the fourth side panel defining a top side end, a bottom side end, a first side end, and a second side end, each of the first side end of the fourth side panel and the second side end of the fourth side panel extending between and intersecting the top side end of the fourth side panel and the bottom side end of the fourth side panel;

a plurality of bottom flaps, a first bottom flap, a second bottom flap, a third bottom flap, and a fourth bottom flap of the plurality of bottom flaps extending from the first side panel, the second side panel, the third side panel, and the fourth side panel, respectively;

a plurality of top flaps, a first top flap, a second top flap, a third top flap, and a fourth top flap of the plurality of the top flaps extending from the first side panel, the second side panel, the third side panel, and the fourth side panel, respectively; the third top flap defining a third handle opening and the fourth top flap defining a fourth handle opening, the third handle opening in the third top flap substantially aligned with the first handle opening in the third side panel when the third top flap is in a folded condition, and the fourth handle opening in the fourth top flap substantially aligned with the second handle opening in the fourth side panel when the fourth top flap is in a folded condition;

a connecting panel extending from a one of the fourth side panel and the first side panel, the connecting panel joining the first side panel and the fourth side panel, the connecting panel extending from the first side panel and joined to the fourth side panel, an outer surface of the connecting panel facing and joined to an inner surface of the fourth side panel; and a pair of tabs extending from the connecting panel and comprising:

a first tab of the pair of tabs extending from a first side end of the connecting panel, the first tab joined to the fourth bottom flap, an outer surface of the first tab facing and joined to an inner surface of the fourth bottom flap, an outside end of the first tab sloped with respect to a bend line joining the first tab to the connecting panel; and a second tab of the pair of tabs extending from a second side end of the connecting panel, the second tab joined to the fourth top flap, an outer surface of the second tab facing and joined to an inner surface of the fourth top flap, an outside end of the second tab sloped with respect to a bend line joining the second tab to the connecting panel;

wherein a centerline of the first handle opening is aligned with a centerline of the third handle opening, and wherein a centerline of the second handle opening is aligned with a centerline of the fourth handle opening;

wherein a first handle flap formed from a portion of the third side panel defining the first handle opening defines a bend line offset from a top end of the box and a cut edge positioned between the bend line and a bottom end of the box; and wherein a second handle flap formed from a portion of the fourth side panel defining the second handle opening defines a bend line offset from the top end of the box and a cut edge positioned between the bend line of the second handle flap and the bottom end of the box.

2. The box of claim 1, wherein:

the third handle opening in the third top flap is substantially aligned with the first handle opening in the third side panel when the third top flap is in the folded condition, an outer surface of the third top flap facing an outer surface of the third side panel or an inner surface of the third top flap facing an inner surface of the third side panel; and the fourth handle opening in the fourth top flap is substantially aligned with the second handle opening in the fourth side panel when the fourth top flap is in the folded condition, an outer surface of the fourth top flap facing an outer surface of the fourth side panel or an inner surface of the fourth top flap facing an inner surface of the fourth side panel.

3. The box of claim 1, wherein the centerline of the first handle opening is aligned with a centerline of the third side panel, and wherein the centerline of the second handle opening is aligned with a centerline of the fourth side panel.

4. The box of claim 1, wherein the centerline of the third handle opening is aligned with a centerline of the third top flap, and wherein the centerline of the fourth handle opening is aligned with a centerline of the fourth top flap.

5. The box of claim 1, wherein each of the first side panel, the second side panel, the third side panel, and the fourth side panel defines a rectangular shape.

6. The box of claim 1, further comprising a connecting panel extending from a one of the fourth side panel and the first side panel.

7. The box of claim 6, further comprising a pair of tabs extending from the connecting panel, a first tab of the pair of tabs extending from a first side end of the connecting panel and a second tab of the pair of tabs extending from a second side end of the connecting panel.

8. The box of claim 1, wherein the box defines a rectangular shape, respective widths of the first side panel and the second side panel being greater than respective widths of the third side panel and the fourth side panel.

9. The box of claim 1, wherein the box defines a rectangular shape, respective widths of the first side panel and the second side panel being greater than respective heights of the first side panel and the second side panel.

10. The box of claim 1, wherein the box defines a rectangular shape, respective widths of the third side panel and the fourth side panel being less than respective heights of the third side panel and the fourth side panel.

11. The box of claim 1, wherein a blank forming the box is formed from a multi-wall material.

12. The box of claim 11, wherein the blank is formed from a double-wall material.

13. The box of claim 1, wherein a blank forming the box comprises a corrugated material.

14. The box of claim 13, wherein the corrugated material comprises a plastic corrugated material.

15. The box of claim 1, wherein a blank forming the box is symmetric about a longitudinal centerline of the box bisecting each of the first side panel, the second side panel, the third side panel, and the fourth side panel.

16. The box of claim 1, wherein a blank forming the box is formed from "A" flute or thicker corrugated material.

17. A method of using the box of claim 1, the method comprising:

obtaining the box;

extending a first hand of a user through and gripping the third handle opening;

extending a second hand of the user through and gripping the fourth handle opening; and lifting the box.

18. The method of claim 17, further comprising:

extending the first hand of the user through and simultaneously gripping both of the first handle opening and the third handle opening; and extending the second hand of the user through and simultaneously gripping both of the second handle opening and the fourth handle opening.

19. The method of claim 18, further comprising:

contacting a surface of the third side panel with a surface of the third top flap, an outer surface of the third side panel contacting an outer surface of the third top flap or an inner surface of the third side panel contacting an inner surface of the third top flap; and contacting a surface of the fourth side panel with a surface of the fourth top flap, an outer surface of the fourth side panel contacting an outer surface of the fourth top flap or an inner surface of the fourth side panel contacting an inner surface of the fourth top flap.

20. The method of claim 19, further comprising:

folding the first handle flap with respect to a remaining portion of the third side panel; and folding the second handle flap with respect to a remaining portion of the fourth side panel.

21. The method of claim 20, further comprising:

folding the first tab with respect to the connecting panel; and folding the second tab with respect to the connecting panel.

* * * * *